United States Patent [19]

Renger

[11] Patent Number: 4,560,362

[45] Date of Patent: Dec. 24, 1985

[54] ANIMATED FIGURE TOY HAVING A MOVEABLE TORSO AND ARTICULATING JAW

[75] Inventor: Larry H. Renger, Hawiian Gardens, Calif.

[73] Assignee: Mattel, Inc., Hawthorne, Calif.

[21] Appl. No.: 688,666

[22] Filed: Jan. 3, 1985

[51] Int. Cl.[4] ..... A63H 3/20

[52] U.S. Cl. ..... 446/340; 446/385

[58] Field of Search ..... 446/340, 339, 337, 395, 446/391, 329, 330, 304, 376, 378, 338, 385

[56] References Cited

U.S. PATENT DOCUMENTS

| | | | |
|---|---|---|---|
| 1,486,101 | 3/1924 | Megorden | 446/337 X |
| 3,009,265 | 11/1961 | Bezark | 35/17 |
| 3,230,664 | 1/1966 | Bornn et al. | 46/118 |
| 3,494,068 | 2/1970 | Crosman | 446/340 X |
| 3,648,405 | 3/1972 | Tepper | 46/120 |
| 3,944,691 | 3/1976 | Smith | 428/13 |
| 4,223,561 | 9/1980 | Guerrero | 21/44 |

FOREIGN PATENT DOCUMENTS

| | | | |
|---|---|---|---|
| 699463 | 11/1953 | United Kingdom | 446/303 |

*Primary Examiner*—Mickey Yu

*Attorney, Agent, or Firm*—Ronald M. Goldman; Melvin A. Klein

[57] ABSTRACT

An animated figure toy (10) includes an upper torso (14) made of transparent material and a lower torso (16) rotatably secured together. The upper torso is provided with a neck opening (30) in which a hollow head is rotatably mounted. The hollow head includes a jaw (19) articulately mounted thereon by a tang portion (78) captured between the upper end (72, 74, 76) of an elongated jaw actuator (64) which extends into and out of the interior of said head upon actuation of a gear train (50, 52, 54) and an eccentric (56) through a torso coupling mechanism (34, 36, 46) upon rotation of the torsos with respect to each other. The transparent upper torso allows the gear train and mechanism to be viewed.

7 Claims, 5 Drawing Figures

ANIMATED FIGURE TOY HAVING A MOVEABLE TORSO AND ARTICULATING JAW

DESCRIPTION

1. Technical Field

The present invention relates to animated figure toys, and more particularly to a new and useful animated figure toy having a moveable torso and articulating jaw.

2. Background Art

U.S. Pat. No. 3,009,265, discloses a simulated human skull which has collapsable or detachable parts showing the components and contours of the skull. The skull includes a moveable lower jaw biased to the closed position by a rubber band.

U.S. Pat. No. 3,230,664, discloses an animated crying doll in which the mouth in the head of the doll may be actuated by a windup spring motor through gearing held in the torso of the doll to simulate a crying baby.

U.S. Pat. No. 3,648,405, discloses a doll having upper and lower torso portions, which torso portions, when twisted, act through meshing gears to move the arms, the head and the lower body of the doll.

U.S. Pat. No. 3,906,661, discloses an animated toy doll having a pair of arms and legs. One arm and one leg may be mechanically moved or ratcheted into cocked positions and held in these positions. The arm or leg may then be released by depressing push buttons in the back of the doll.

U.S. Pat. No. 3,944,691, discloses a toy consisting of a transparent image of some representational symbol, such as the mascot or the like of a football team, with a further or second representational image imbedded within the first image.

U.S. Pat. No. 4,087,933, assigned to the assignee of the present application, shows a doll having a transparent or see through chest with viewable internal organs within the chest.

Finally, U.S. Pat. No. 4,223,561, also assigned to the assignee of the instant application, discloses a figure toy having a motion translation means therein whereby compression of the torso of the doll pivots the head of the doll, and causes a kissing action by the mouth of the doll.

None of the above identified patents disclose the specific transparent, animated figure toy of the present invention having rotating gearing, levers and an operating jaw coacting therewith.

DISCLOSURE OF THE INVENTION

In accordance with the present invention, a new and useful animated figure toy is provided with a twisting torso and moveable jaw. The figure toy includes an upper torso, a lower torso and means rotatably connected within the upper torso whereby when the torsos are rotated relative to each other, gearing and lever means in the upper torso will be operated, and the jaw moved.

The figure toy includes a partially transparent upper torso to show the movement of the gearing and lever means held therein.

The figure toy also includes an elongated shaft for coupling the gearing and lever means in the upper torso to the jaw in the head of the figure toy. The elongated means is operated in such a fashion that the movement of the jaw will always take place, no matter what direction the torsos are turned, or in what position the head on the figure toy is in relation to the torsos.

BRIEF DESCRIPTION OF THE DRAWINGS

Details of the present invention will be described in connection with the accompanying drawings wherein.

BEST MODE FOR CARRYING OUT THE INVENTION

Figure 1:
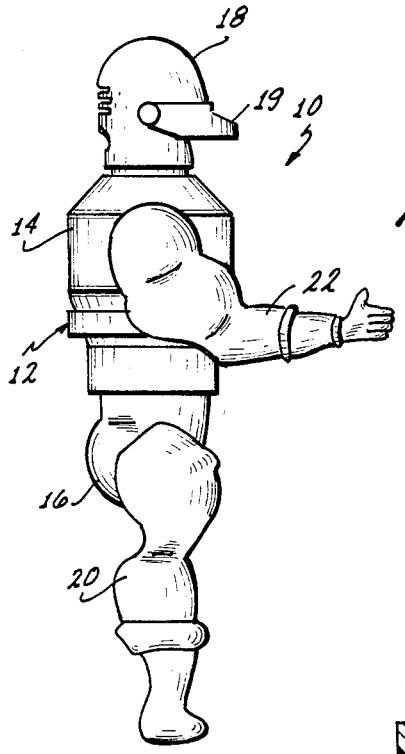
FIG. 1 is a side elevational view of an animated figure toy consisting of a presently preferred embodiment of the invention.

Referring now to the drawings, a figure toy constituting a presently preferred embodiment of the invention is generally designated 10. The figure toy includes a hollow body 12 comprising a hollow upper torso 14 and a hollow lower torso 16, which may be rotated with respect to each other.

Figure toy 10 also includes a rotatable hollow head assembly 18, having an articulated mouth or jaw 19, and various arms, legs or other appendages 20, 22, only one of each being shown in FIG. 1.

Figure 4:
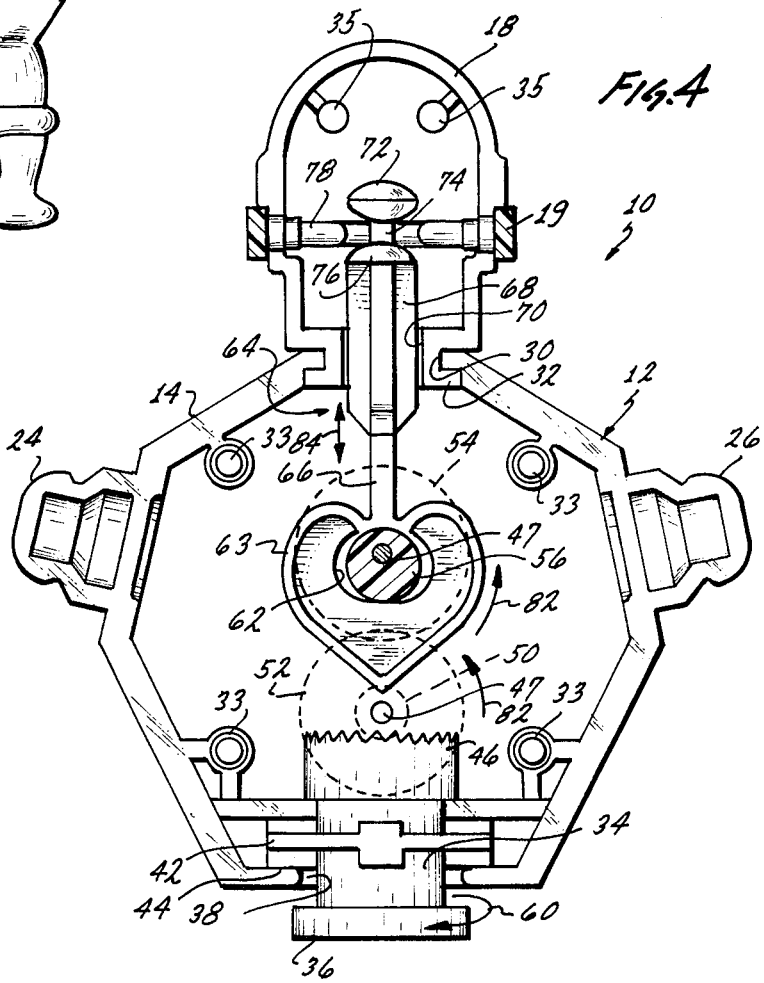
FIG. 4 is a cross-sectional view taken along line 4—4 of FIG. 3, showing the back halves of the upper torso and head.

As shown in FIG. 4, protuberances, stubs or other means 24, 26 are fixed to or integrally formed with the upper torso 14 to allow arms to be attached thereto. Legs 20 may be attached to the lower torso 16 in a similar manner.

Both halves 28, 48, or only a front chest portion of the upper torso 14 may be formed from a transparent material, as by molding. This transparent torso or chest allows the gears and lever means formed and rotatably mounted within the upper torso to be seen, as explained more fully hereinafter.

Figure 2:
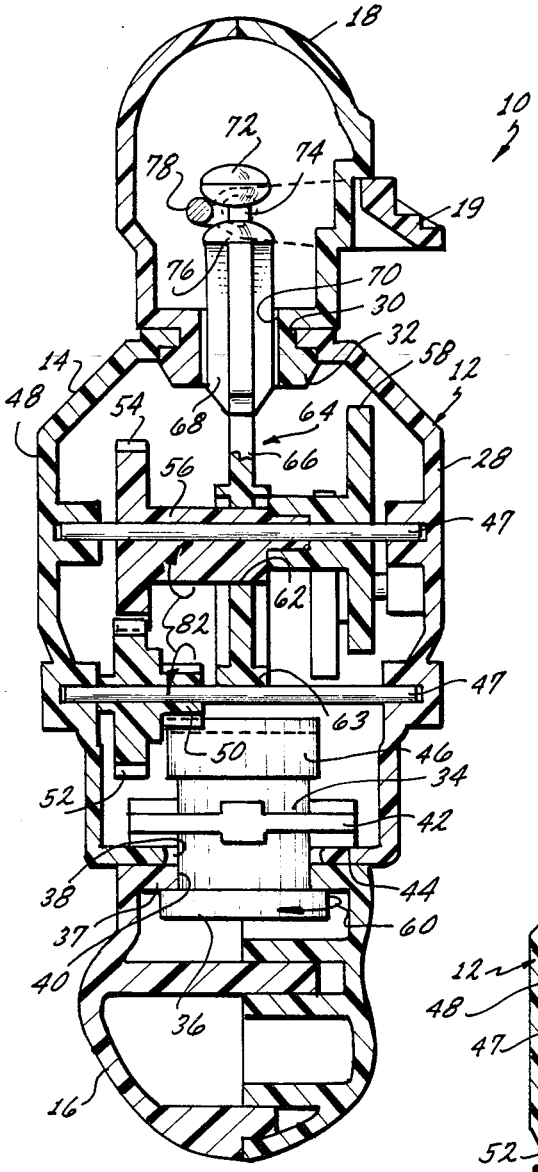
FIG. 2 is an enlarged sectional view through the head and torsos of FIG. 1, with the limbs removed, and showing the construction of the gearing and operating elements thereof.
Figure 3:
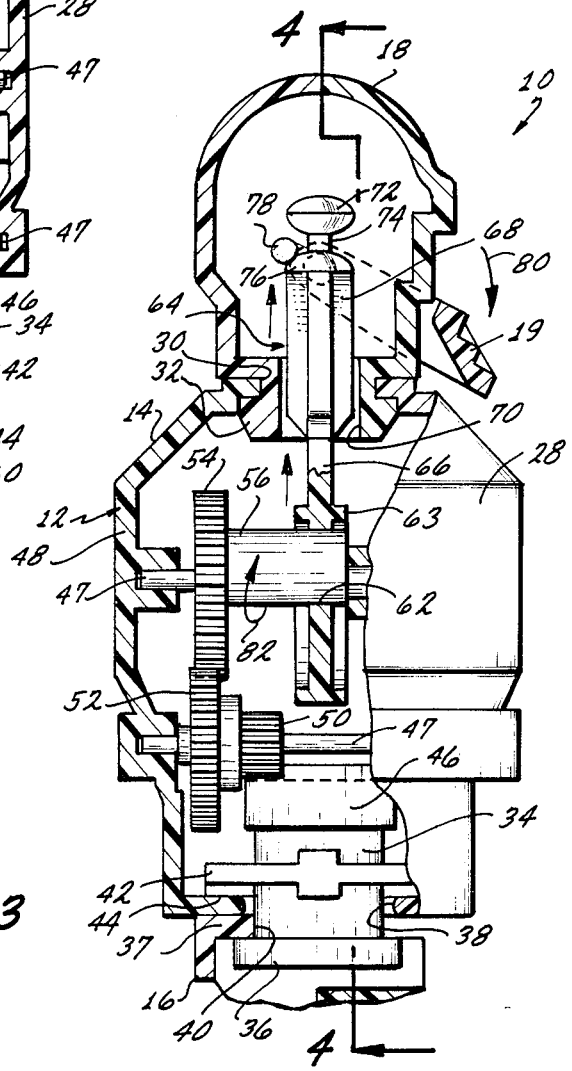
FIG. 3 is an enlarged partial sectional view, similar to FIG. 2, but with some of the operating gearing being shown in full, and the rotational movement of the gearing and torsos being indicated to move the elongated member upwardly through an opening in the top of the torso, into the head, to operate the jaw.
Figure 5:
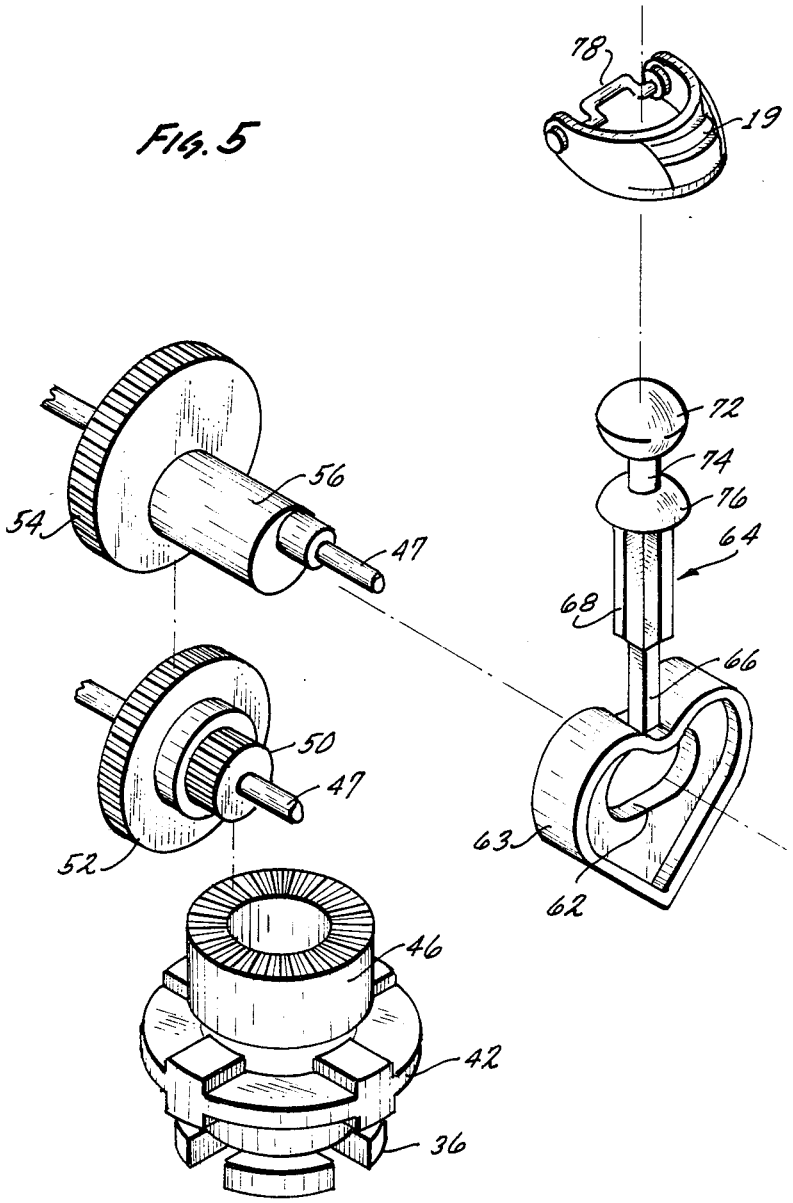
FIG. 5 is an exploded schematic view of the internal operating gear train, elongated member, and jaw of the present invention.

Referring now to FIGS. 2 through 4, upper torso 14 is shown as being provided with a neck opening 30 into which a lower portion 32 of head 18 is captured or journaled for rotational movement with respect to the upper torso through 360 degrees.

Both halves of the hollow head 18 and the upper and lower torsos 14, 16 may be molded from suitable polymeric material and, as shown in FIG. 4, may be suitably held together by pin and socket type connectors 33, 35, or in any other suitable manner.

Housed within the upper torso 14 is a plurality of gears (50, 52, 54) forming a gear train, which are connected with a suitable rod or elongated member 64 which extends upwardly into the interior of the hollow head to operate the jaw 19, as explained more fully hereinafter.

Lower torso 16 is rotatably connected to upper torso 14 by means of a torso connector 34 having a lower cylindrical boss 36 formed integrally with the torso connector and captured within the lower torso 16 by coaction of the boss 36 with a wall 37 for rotational movement therewith. The torso connector 34 extends through an opening 40 formed within the wall 37 of the lower torso 16, and is further aligned with an opening 38 formed within a wall 44 forming the base of the upper torso 14.

The torso connector also includes a central bearing means or plate 42 which rests on and is rotatably carried by flattened wall portion 44 of the upper torso 14.

Finally, the torso connector 34 includes a crown gear 46 at the top thereof for coaction with and operation of the gear train held within the upper torso and the elongated member or rod 64 extending into the hollow interior of the head 18 for operation of the jaw.

A plurality of shafts 47 are fixedly held between the two halves of the upper torso 14 by means fixed to or integrally formed on the interior of the front torso half 28 and the separate rear torso half 48. Rotatably mounted on each shaft 47 are the gears 50, 52, 54 which comprise the gear train. The spur gear 50 is driven by the crown gear 46 of the torso connector 34, upon relative rotation of the two torsos. The further gear means 52 is coupled with or formed integrally with spur gear 50 and connects with and drives the intermediate gear 54 having a cam or eccentric 56 formed integrally therewith. In addition, as shown more clearly in FIG. 2, one or more further gears 58 may be mounted on the shafts 47, and driven in any convenient manner, as through the end of the eccentric 56. These other gears 58 may be provided at the front or rear of the transparent upper torso and may be made from or include various colors and/or be shaped so as to provide pleasing visual effects, such as a strobe or the like, when turned with the gear train.

The upper torso 14 and the lower torso 16 may be turned in either direction with respect to each other. However, as shown in FIGS. 2 through 4, when the lower torso 16 is turned in the clockwise direction, as shown by arrow 60, the gears turn in the direction indicated by the arrows 82.

For purposes of illustration only, the actuation of the gear train and the turning of the torsos with respect to each other will now be described as if the lower torso is being turned in the clockwise direction, as shown by arrow 60. The gear means within the upper torso 14 will turn as indicated by arrows 82 to rotate the eccentric cam 56, in the same direction. Cam 56 acts within an opening or slot 62 formed within the lower portion 63 of a jaw actuator, elongated member or rod 64. The lower portion 63 is preferably heart shaped, so as to be visually pleasing when seen through the transparent upper torso. The rod 64 includes a central connecting portion 66 integrally formed with or fixedly attached to the lower heart shaped member 63. A plurality of guiding ribs 68 are provided around the central portion 66 to reciprocally guide the jaw actuator 64 within an opening 70 formed internally within the neck or lower portion 32 of the hollow head 18.

The upper end of the jaw actuator within the head 18 is provided with an enlarged upper knob portion 72, a narrowed connecting neck portion 74, and a half rounded lower section 76 formed over the guides 68, and spaced from the upper knob 72.

The jaw 19, mounted externally of the head 18, is provided with a horseshoe or U-shaped tang 78 extending entirely through the head from opposite sides thereof. The jaw 19 is rotatably attached to the head at opposite sides thereof, and extends into the hollow interior by means of the tang 78, which straddles, or is captured between, the upper knob 72 and half round 76 of the jaw actuator 64. In this manner, the jaw will be rotated about the points where it is fixed to the head. That is, it will be articulated in the manner of a moving mouth, in the direction of the arrow 80, from the closed position shown in FIGS. 1 and 2 to the opened position shown in FIG. 3. This movement is accomplished by actuation of the gearing means, as explained before, which causes reciprocating movement of the jaw actuator 64 upwardly into the interior of hollow head 18. That is, when the gear 54 and eccentric cam 56 are rotated in the direction of the arrows 82, by movement of the lower torso, 16 the remaining gears are rotated in the indicated directions, and the rod will reciprocate into and out of head 18, thereby articulating jaw 19, from the closed to the opened position, and back again, as long as the torsos are rotated.

Due to the unique design of the upper end of the jaw actuator 64, namely the half round 76, knob 72 and neck 74 connecting the same, the head may be rotated through 360 degrees and left in any position, with no adverse or restricting affect upon the articulation of the jaw. As explained previously, the jaw is articulated through the gears, as the upper and lower torsos are rotated, in either direction, with respect to each other. That is, the rotary motion of the torsos with respect to each other is translated into both rotary motion of the gear train and reciprocating motion of the jaw actuator 64 (arrow 84).

While the particular animated figure toy herein shown and described in detail is fully capable of attaining the objects and providing the advantages hereinbefore stated, it is to be understood that it is merely illustrative of the presently preferred embodiment of the invention, and that no limitations are intended by the details of construction or design herein shown and described, other than as defined in the appended claims.

The term "means", as employed in the claims is to be interpreted as defining the corresponding structure illustrated and described in the specification or equivalent thereof.

I claim:

1. In combination with a figure toy having an upper torso, a lower torso and a head, and means rotatably connecting said lower torso to said upper torso, and further means rotatably mounting said head on said upper torso, the improvement which comprises:

a jaw member articulately mounted on said head;

a gear train and elongated rod means connected together and moveably mounted within said upper torso, and coupled to said jaw member; and means coupling said upper and lower torsos together and coacting with said gear train whereby, upon rotation of said torsos with respect to each other, said gear train will be actuated to reciprocate said elongated member to thereby articulate said jaw.

2. The combination of claim 1 wherein said means coupling said upper and lower torsos together includes a crown gear held within said upper torso and coupled to said gear train for actuation thereof.

3. The combination of claim 1 wherein said head is hollow and includes internally thereof an opening through which said jaw actuator extends into the hollow interior thereof for connection with a tang member fixedly connected to said jaw.

4. The combination of claim 3 wherein said gear train includes an eccentric cam held within a follower slot formed at the lower end of said jaw actuator.

5. The combination as recited in claim 4 wherein a portion of said upper torso is transparent so that the action of the moving gearing means and jaw actuator mounted therein may be viewed.

6. The combination as recited in claim 4 wherein said entire upper torso is molded from a transparent plastic material in two halves held together, whereby the operation of the gears and jaw actuator mounted therein may be viewed.

7. In combination with a figure toy having an upper torso, a lower torso, and means rotatably connecting said lower torso to said upper torso, and with said upper torso having a neck opening with a hollow head rotatably mounted therein, the improvement which comprises:

a gear train rotatably mounted within said upper torso, and an eccentric cam formed integrally with one of the gears of said gear train;

a jaw actuator comprising an upper elongated portion and a lower heart-shaped portion, said upper portion extending through an opening formed within said head into the hollow interior thereof, said lower heart-shaped portion having a slot formed therein mounted over said eccentric cam;

a jaw articulately mounted on said head and including a tang portion extending internally into the hollow interior of said head, said tang portion captured within said upper elongated portion; and said means coupling said upper and lower torsos together being connected to said gear train, whereby upon rotation of said torsos with respect to each other, said gear train will be rotated, and said jaw actuator will be reciprocated within said upper torso into and out of said interior of said head to thereby articulate said jaw with respect to said head.

* * * * *